US008684777B2

(12) United States Patent
Jemt

(10) Patent No.: US 8,684,777 B2
(45) Date of Patent: Apr. 1, 2014

(54) PROPULSION DEVICE FOR PROPELLING A FLOATING WATERCRAFT, A CONVERSION KIT FOR REPLACING A PROPELLER WHERE THE KIT COMPRISES SUCH A PROPULSION DEVICE, A WATERCRAFT COMPRISING SUCH A PROPULSION DEVICE AND A METHOD FOR INCREASING THE EFFICIENCY BY USING SUCH A CONVERSION KIT

(75) Inventor: Thomas Jemt, Vällingby (SE)

(73) Assignee: Dolprop Industries AB, Stockholm (SE)

( * ) Notice: Subject to any disclaimer, the term of this patent is extended or adjusted under 35 U.S.C. 154(b) by 147 days.

(21) Appl. No.: 12/594,359

(22) PCT Filed: Apr. 2, 2008

(86) PCT No.: PCT/SE2008/000240

§ 371 (c)(1),
(2), (4) Date: Jan. 5, 2010

(87) PCT Pub. No.: WO2008/123815

PCT Pub. Date: Oct. 16, 2008

(65) Prior Publication Data

US 2010/0151751 A1 Jun. 17, 2010

Related U.S. Application Data

(60) Provisional application No. 60/909,994, filed on Apr. 4, 2007.

(30) Foreign Application Priority Data

Apr. 4, 2007 (SE) ..... 0700849-3

(51) Int. Cl.
*B63H 1/36* (2006.01)

(52) U.S. Cl.
USPC ..... 440/15

(58) Field of Classification Search
USPC ..... 440/13–15
See application file for complete search history.

(56) References Cited

U.S. PATENT DOCUMENTS 2,364,255 A 12/1944 Troth
3,215,371 A 11/1965 Wilhelm (Continued)

FOREIGN PATENT DOCUMENTS

CN 1663881 9/2005
DE 2346051 3/1975

(Continued)

OTHER PUBLICATIONS

International Search Report for corresponding application No. PCT/SE2008/00240 completed Jul. 17, 2008.
International Preliminary Report on Patentability for corresponding application No. PCT/SE2008/00240 dated Jul. 24, 2009.

*Primary Examiner* — Stephen Avila
(74) *Attorney, Agent, or Firm* — Renner, Otto, Boisselle & Sklar, LLP

(57) ABSTRACT

A propulsion device and a watercraft including the propulsion device. The propulsion device comprises a flexible fluke that is pivotable about a horizontal axis, for propelling a floating watercraft. The propulsion device is adapted for connection to an output drive shaft that transmits rotary motion. The propulsion device comprises a fluke oscillation drive having gear reduction of the rotary motion transmitted by the shaft and a mechanism for converting the rotary motion transmitted by the shaft to oscillatory motion of the fluke.

18 Claims, 4 Drawing Sheets

(56) References Cited

U.S. PATENT DOCUMENTS

| | | | | |
|---|---|---|---|---|
| 3,529,565 | A | 9/1970 | Iglesias | |
| 3,695,211 | A | 10/1972 | Gross | |
| 3,855,957 | A | 12/1974 | Gross | |
| 3,874,320 | A | 4/1975 | Wood | |
| 4,541,810 | A | 9/1985 | Wenzel | |
| 4,968,273 | A | 11/1990 | Momot | |
| 5,934,952 | A | 8/1999 | Scanlon | |
| 6,341,993 | B1 | 1/2002 | Lalli | |
| 6,524,145 | B1 | 2/2003 | Arzate | |
| 7,662,004 | B1 * | 2/2010 | March et al. | 440/14 |
| 2004/0195440 | A1 | 10/2004 | Liu | |
| 2004/0266279 | A1 | 12/2004 | Jelten | |
| 2005/0027412 | A1 | 2/2005 | Hobson et al. | |
| 2005/0241425 | A1 * | 11/2005 | Oguma | 74/473.1 |

FOREIGN PATENT DOCUMENTS

| | | |
|---|---|---|
| EP | 1852589 | 11/2007 |
| FR | 2898580 | 9/2007 |
| GB | 191514418 | 8/1916 |
| GB | 455688 | 10/1936 |
| JP | 52103196 | 8/1977 |
| JP | 54045845 | 4/1979 |
| JP | 35505591 | 4/1980 |
| JP | 55140694 | 11/1980 |
| JP | 56086890 | 7/1981 |
| JP | 1036598 | 2/1989 |
| JP | 11029094 | 2/1999 |
| JP | 2001163296 | 6/2001 |
| JP | 4090989 | 5/2008 |
| WO | 2007087664 | 8/2007 |

* cited by examiner

PROPULSION DEVICE FOR PROPELLING A FLOATING WATERCRAFT, A CONVERSION KIT FOR REPLACING A PROPELLER WHERE THE KIT COMPRISES SUCH A PROPULSION DEVICE, A WATERCRAFT COMPRISING SUCH A PROPULSION DEVICE AND A METHOD FOR INCREASING THE EFFICIENCY BY USING SUCH A CONVERSION KIT

This application is a national phase of International Application No. PCT/SE2008/000240 filed Apr. 2, 2008 and published in the English language.

FIELD OF THE INVENTION

The present invention relates to a propulsion device comprising a submerged fluke for propelling a watercraft.

BACKGROUND OF THE INVENTION

Common devices for propelling watercraft include submerged rotating propellers, waterjets and the like. A conventional rotating propeller rarely presents an efficiency above 20%, and will also suffer from cavitation at higher rotary speeds. The very low efficiency of a conventional rotating propeller results in high operation costs and a strong impact on the environment from the emissions of any combustion engine powering the propeller. A conventional rotating propeller is also prone to get entangled with fishing net, rope, line, plastic sheet or other floating debris, and may cause harm to swimmers and animal life that come near the propeller. In the disclosure below, the term rotatable propeller refers to the above mentioned conventional, helical or screw type rotatable propellers that are predominant today and known well to those skilled in the art.

An example of a propulsion device comprising a rotatable propeller is disclosed in the European patent publication EP1852589A2.

SUMMARY OF THE INVENTION

It is an object of the present invention to overcome or at least mitigate some or all of the problems described above.

With the foregoing and other objects in view, there is provided a propulsion device for propelling a floating watercraft, the propulsion device comprising a flexible fluke that is pivotable about a horizontal axis. The propulsion device is adapted to be connected to an output drive shaft that is adapted for transmitting a rotary motion. Further, the propulsion device comprises a fluke oscillation drive having means for gear reduction of the rotary motion transmitted by the shaft and means for converting the rotary motion transmitted by the shaft to oscillatory motion of the fluke.

Preferably, the horizontal axis around which the fluke is pivotable is perpendicular to the watercraft's propulsion direction resulting from the operation of the fluke.

The propulsion device is arranged to be connected to a floating watercraft, and the fluke is arranged to be located below the waterline of the watercraft and pivotable vertically about a horizontal axis. As a result of the vertical operation, the counter-acting buoyancy and gravitation of the watercraft keep the watercraft in a vertically more or less locked position, minimizing thrust loss through vibrations and reaction motion of the watercraft. The vertical locking will direct the thrust of the fluke in the forward direction in a manner similar to how the keel or the centerboard of a sailboat provides the lateral resistance to sail upwind.

To achieve fluke oscillation, the rotational energy of an output drive shaft, i.e. a power transmission shaft of either an engine or a gearbox, is arranged to be converted to an oscillatory motion of the fluke, and the fast rotation of the output drive shaft is arranged to be geared down via a reduction gear to obtain the appropriate oscillation frequency. The lowering of the oscillation frequency using a reduction gear yields an impressive and surprisingly high increase of the propulsion efficiency of the fluke.

The fluke is arranged to be flexible in order to assume the correct shape to cup and propel the flowing water in a well-directed backward jet.

All these features combine and interoperate to result in a high efficiency of the propulsion device.

A few further criteria should be fulfilled to achieve optimum performance and/or additional practical features:

Preferably, the fluke comprises reinforcements of steel or some other suitable material that assist in giving the fluke the correct shape when loaded. A flexible fluke could be made of, including but not limited to, spring-grade steel or a rubber-like material, such as latex, silicone rubber or polyurethane, or it could consist of several rigid parts, separated by flexible joints.

Preferably, the transmission ratio of the reduction gear is between 8:1 and 100:1, and more preferably between 8:1 and 32:1. This transmission ratio is particularly well suited for combustion engines, having a typical engine speed of the order 500-10000 RPM. 16:1 is a very suitable transmission ratio for a wide range of engines; particularly those having a maximum engine speed of the order 6000 RPM, yielding an oscillation frequency when in operation of the order 0.5-5 Hz.

Preferably, the propulsion device is adapted to receive a rotary output power from the output drive shaft of more than 300 Watts. At engine powers below 300 Watts, the efficiency benefit of the gear reduction is significantly reduced as the reduction gear friction will always consume a certain power.

Preferably, the propulsion device comprises means for propelling the watercraft in the reverse direction for maximum manoeuvrability and to allow motorized speed reduction. This means may be implemented with e.g. an impeller.

Preferably, the fluke may be arranged to have the general shape of the tail of a bottle-nose dolphin to reduce vortex and turbulent loss of thrust force. This shape also gives the fluke a generous stall angle, or efficient angle of attack, which is desired in fluke propulsion systems with variable fluke oscillation amplitude.

Preferably, the means for gear reduction and the means for converting the rotary motion to oscillatory motion are comprised in a housing. In this manner, rotating parts will be protected from getting entangled with, being damaged by, or damaging any objects in the water surrounding the propulsion device.

In one embodiment, the output drive shaft is the propeller shaft of the watercraft, i.e. the conventional location for attaching a legacy rotating propeller to a watercraft or to the lower unit of a stern drive or of an outboard motor. In this way, the watercraft propulsion device can be connected to motors that exist on the market today or are already in operation; in one embodiment by simply replacing the propeller unit with a unit comprising a fluke oscillation drive and a fluke. A watercraft propulsion device of this type can also be adapted to fit to both inboard, stern drive and outboard motors with very small modifications. Economical, environmental and safe propulsion will thus be made available even for legacy outboard, stern drive and inboard motors.

According to one aspect of the invention, there is provided a conversion kit for replacing a rotatable propeller of a sterndrive or an outboard or inboard motor that is configured for operating the rotatable propeller at a rotary speed of more than 200 RPM. The kit comprises any of the propulsion devices of the present invention, wherein the propulsion device is adapted to be connected to the propeller shaft of the motor or sterndrive. Clearly, the propulsion device of the kit can be connected to the propeller shaft irrespectively if the propeller shaft was previously provided with a rotatable propeller, or if the propeller was never provided with any propeller at all. Both those cases are covered by the appended claims.

Typically, a rotatable propeller operates in the range 200-6000 RPM. Therefore, for a conversion kit for replacing a rotatable propeller, the suitable transmission ratio of the reduction gear of the fluke oscillation drive preferably is lower than if the propulsion device would be connected directly to the output of a combustion engine. In order to reach the suitable RPM range of a rotatable propeller, a typical legacy outboard or inboard motor has a gear reduction between the engine output and the propeller of between 1:1 and 4:1, depending on the rotatable propeller type and the RPM range of the engine. This means that a preferable transmission ratio of the reduction gear is between 2:1 and 100:1, depending on any reduction gear already present in the legacy motor, and more preferred between 4:1 and 32:1.

According to another aspect of the invention, there is provided a method for increasing the efficiency of a watercraft propulsion device adapted for rotating a rotatable propeller at a rotary speed of more than 200 RPM by means of a propeller shaft (20), the method being characterized in replacing the rotatable propeller with any of the propulsion devices of the present invention.

The present invention thus offers means to propel a floating watercraft in a manner that offers high efficiency, that is virtually harmless to people and animal life in the water near the propulsion device, and that is virtually insensitive to fishing net, seaweed, rope, line, plastic sheet or other floating debris in the water, but most of all, it also offers this means to conventional watercraft that were originally designed for propulsion by means of rotating propellers.

BRIEF DESCRIPTION OF THE DRAWINGS

All figures are provided for illustrative convenience only; they illustrate different aspects of the invention, but should not be understood to limit the scope of the invention as expressed in the appended claims.

DETAILED DESCRIPTION OF THE EXEMPLARY EMBODIMENTS

Figure 1A:
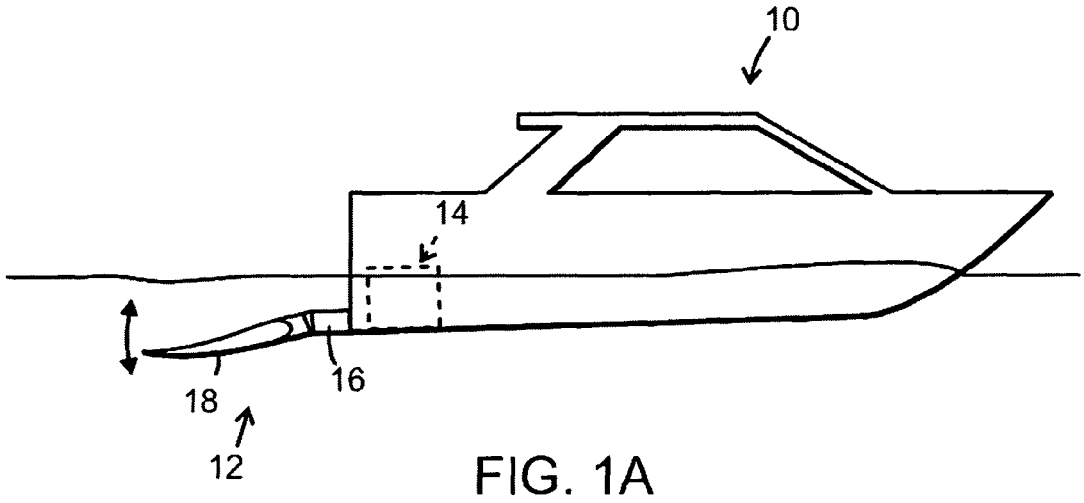
FIG. 1A is a diagrammatic illustration of a watercraft having an inboard motor connected to a watercraft propulsion device according to the invention.

Some of the drawbacks of a rotatable propeller are briefly discussed above. A propulsion method less frequently used is by means of submerged oscillating fins or flukes attached to the watercraft. However, the use of fins or flukes is not yet commonplace for a number of reasons, some of which will be briefly explained further below.

The vast majority of the priorly known flukes/fins feature a motion in the horizontal plane. U.S. Pat. No. 3,855,957, for example, describes a muscle-powered, flexible dorsal fin propulsion system to be mounted on the stern of a small boat.

A boat propelled by a vertically moving, horizontally extending rigid fluke is described in GB patent 1915 14 418, which was published as early as in 1915. The fluke is mounted on the hull of the boat, and powered by an engine.

A boat propelled by two vertically moving, flexible flukes operated via a seesaw-like device through holes in the hull of the boat is disclosed in JP patent application 54 045 845.

A device propelled by a fin, oscillating either vertically or horizontally, powered by muscle or a rubber band is described in JP patent 52103196, which was published in 1977. The fluke will oscillate with the same frequency as the outgoing axis from the rubber band. The constructions, having open, unjournalled linkages, is intended for toys or swimming appliances.

An outboard engine operating a stabilizing wing, which takes a wave propulsive motion, is described in JP patent 11376278.

Even though a well designed fluke can, in theory, reach an efficiency above 80%, none of the devices above offers an efficiency which is competitive compared to a rotatable propeller. None of the above referred documents have specified which fluke propulsion device features are of importance for high efficiency, and even less presented an efficient and realistic design that is suited for propulsion of watercraft capable of transporting goods and/or passengers. This is probably part of the reason why fluke propulsion has, until now, only appeared as odd sidetracks and dead ends of the evolution of ship propulsion. None of the above described fluke propulsion devices thus serves as the most promising springboard towards the invention of a realistic, efficient, reliable and safe propulsion device; particularly in the light of the predominance of the rotatable propeller.

The vast majority of the known fluke propulsion devices comprise a horizontally moving fluke, in an attempt to mimic fish. These devices are not very efficient and introduce very strong vibrations in the watercraft, as there is no strong resistive force that locks the position of the watercraft sideways. Every motion of the fluke will result in a corresponding reaction motion of the propelled object, which not only limits efficiency but also puts severe constraints on the maximum size of a propulsion fluke.

Minimizing vibrations and reaction motion is however not enough to yield high efficiency; it is also necessary to carefully design the shape so as to minimize turbulence, to give the fluke the correct elasticity profile over the different parts of the fluke to achieve the correct fluke shape when the fluke is loaded, to give the fluke the correct surface features, and to design the correct motional trajectory or motion pattern. It is also necessary to operate the fluke at a correct oscillation frequency to achieve a high efficiency.

Another important reason why fluke/fin propulsion has not yet become a commercial success is that all of the solutions priorly described involve a complete engine and transmission solution or require other significant modifications to an existing watercraft driven by conventional rotating propellers. This means that it is complicated and expensive for a boat-owner to implement fluke propulsion on his/her boat, as it would be necessary to buy a large and complicated system that requires significant modifications to the boat, or even to buy a completely new boat designed specifically for fluke propulsion.

In the exemplary embodiments described in detail below, the above mentioned and other problems are addressed and mitigated.

Figure 1B:
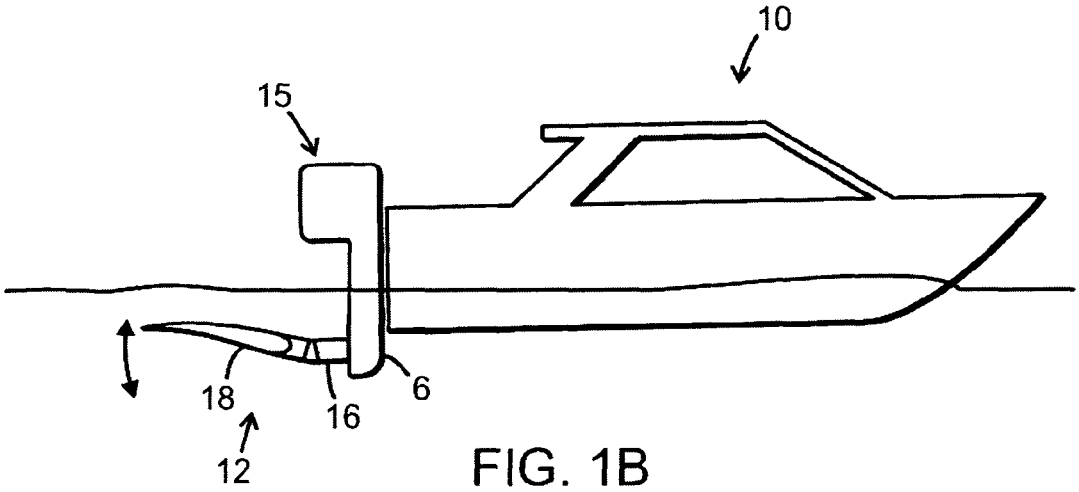
FIG. 1B is a diagrammatic illustration of a watercraft having an outboard motor connected to a watercraft propulsion device according to the invention.

FIG. 1A shows one aspect of the invention, where a floating watercraft 10 is propelled by a propulsion device 12 comprising a single fluke 18, which is powered by an inboard motor 14. FIG. 1B shows a similar fluke propelled watercraft, but the motor 15 is an outboard motor that is attached to the stern of the watercraft 10 instead of being located inside the watercraft, and the propulsion device 12 is connected to the lower unit 6 of the outboard motor 15. The watercrafts of FIGS. 1A and 1B are of a size and construction to be capable of transporting goods and/or passengers, e.g. for rescue missions, and the propulsion device 12 produces a thrust high enough for propelling the watercraft. The motor 14, 15 may be, e.g., a combustion motor, an electric motor, a hydraulic motor, or similar.

Figure 2:
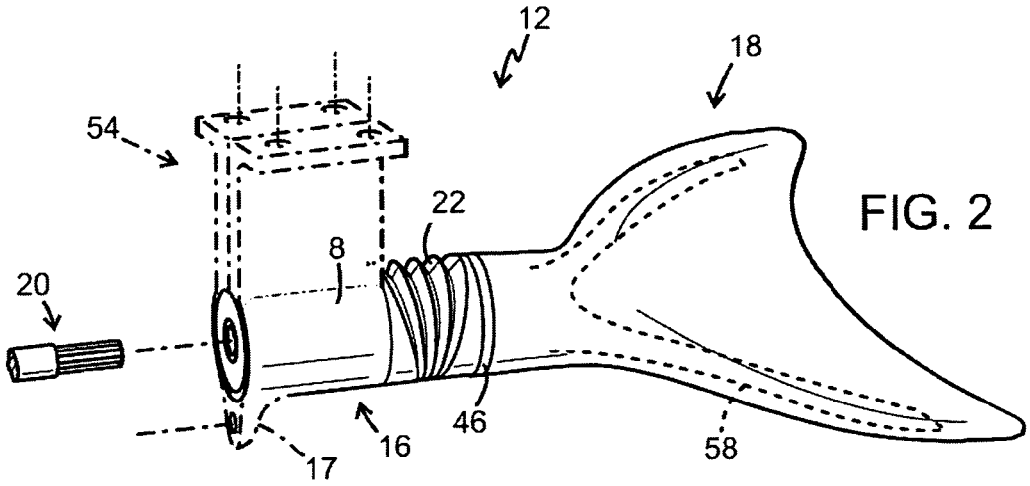
FIG. 2 is a diagrammatic illustration of a watercraft propulsion device according to the invention.

FIG. 2 is a close-up showing an example of how a propulsion device according to the present invention, as exemplified in FIG. 1B, may be implemented. The propulsion device 12 in this example comprises a fluke oscillation drive 16, and a fluke 18. The propulsion device may in this example be connected to an outboard motor 15 in such a way that the fluke oscillation drive housing 8 is attached and rotationally fixed to the housing 4 of the lower unit 6 of the outboard motor 15, and the rotating propeller shaft 20 of the outboard motor 15 transmits rotary motion to the fluke oscillation drive 16. A non-rotational connection may be achieved by means of e.g. a bolt 17, or by structural elements 19 of the fluke oscillation drive housing 8 gripping into structural elements 21 of the housing 4 of the lower unit 6. The purpose of the fluke oscillation drive 16 is to convert the rotary motion delivered by the propeller shaft 20 to oscillatory motion of an appropriate oscillation frequency of the fluke 18. The joint between the fluke oscillation drive 16 and the fluke 18 is protected by bellows 22. The fluke 18 may comprise reinforcements 58.

The motor 14 may be an outboard motor, an inboard motor, or a stern drive motor. The propulsion device may be connected to the lower unit of an outboard motor or of a stern drive motor, or to the hull of a watercraft having an inboard motor. Further, there are many ways to attach the propulsion device to the lower unit or hull; it may be bolted, welded, riveted, glued, or fixed using any other type of joint or combination of joints. The motor may be of any type suitable for the size and type of watercraft; it may be a combustion engine, an electric motor, a steam-engine, a nuclear-powered turbine, or any other type of motor. All of these cases are covered by the appended claims.

Figure 3:
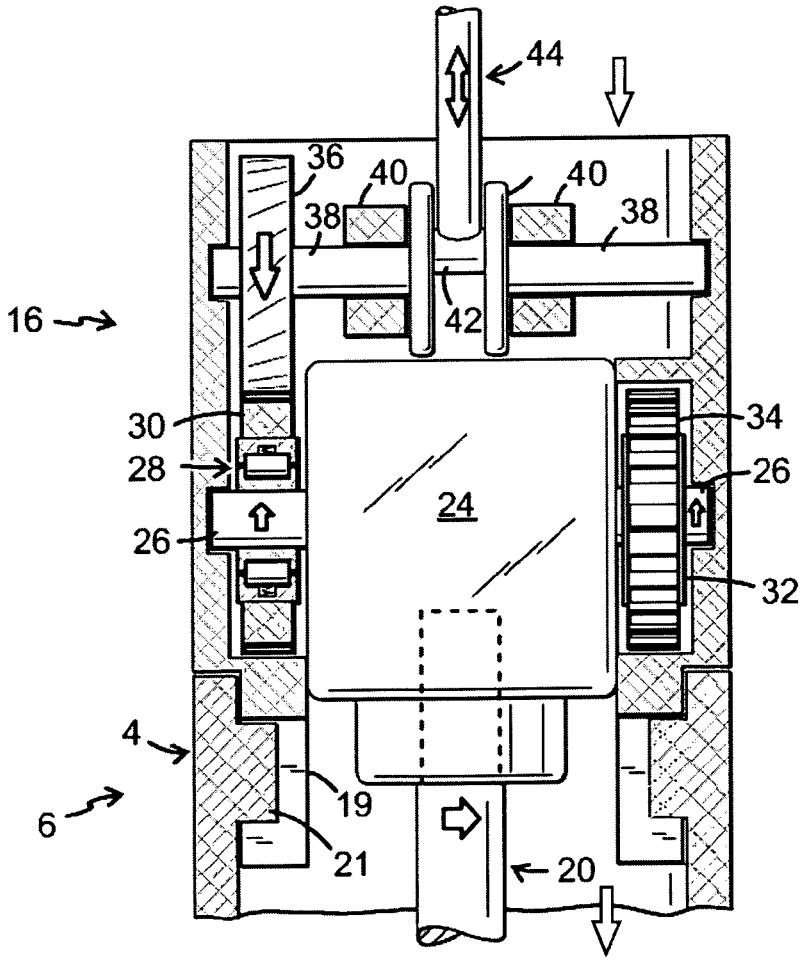
FIG. 3 is a more detailed view, diagrammatically illustrating the interior of a fluke oscillation drive of a watercraft propulsion device according to the invention.

FIG. 3 shows an example of an embodiment of the fluke oscillation drive 16. It comprises means for propelling a watercraft in the backward direction using an impeller.

The rotary motion of the propeller shaft 20 drives a worm gear 24 which in turn drives a shaft 26 having an axis of rotation that is substantially perpendicular to the axis of rotation of the propeller shaft 20. Apart from transferring the rotary motion to a shaft having a different direction of the axis of rotation, the worm gear 24 also performs gear reduction. The shaft 26 is connected to a first overrunning clutch 28, which engages a forward gear 30 when the propeller shaft 20 reaches a first rotation speed in a first rotation direction. Further, the shaft 26 is connected to a second overrunning clutch 32, which engages an impeller 34 when the propeller shaft 20 reaches a second rotation speed in a second rotation direction that is reverse to the first rotation direction.

Water may enter the impeller 34 through an inlet nozzle, not shown in the figure, and formed into a jet through an outlet nozzle, not shown in the figure. The nozzles, which are in fluid connection with the impeller 34 via channels through the housing 8 that are located in a different plane than the one shown in the figure, point in such directions that the jet may be used to lower the forward speed of the watercraft or propel it in the reverse direction. Even though neither the nozzles nor the channels, for the sake of clarity, are shown in the figure, the water flow direction at the inlet and outlet nozzles is indicated by arrows.

The forward gear 30 drives a crank shaft gear 36, which is connected to a crank shaft 38 that is rotationally journalled in bearings 40. The crank shaft 38 comprises a crank pin 42, to which the first end of a connecting rod 44 is connected and rotationally journalled in bearings.

The means for changing the direction of the rotation axis in the fluke oscillation drive 16 is not limited to a worm gear. Other means may also be used and are covered by the appended claims, e.g. perpendicular bevel gears.

The gear reduction of the rotary motion from the propeller shaft 20 can be implemented in many different ways. Other means than a worm gear may be used and are covered by the appended claims, such as continuously variable transmission, planet, hypocycloid or epicyclic gears, derailleur gears etc.

The rotary motion of the axle 26 may be transferred to rotary motion of the crankshaft 38 in many different ways. Other means than those described above may be used and are covered by the appended claims, such as belt, chain, etc.

Also, the rotational motion may be converted to oscillatory motion in many different ways. Other means than a crank shaft may also be used and are covered by the appended claims, e.g. a camshaft or planet gear.

Figure 4:
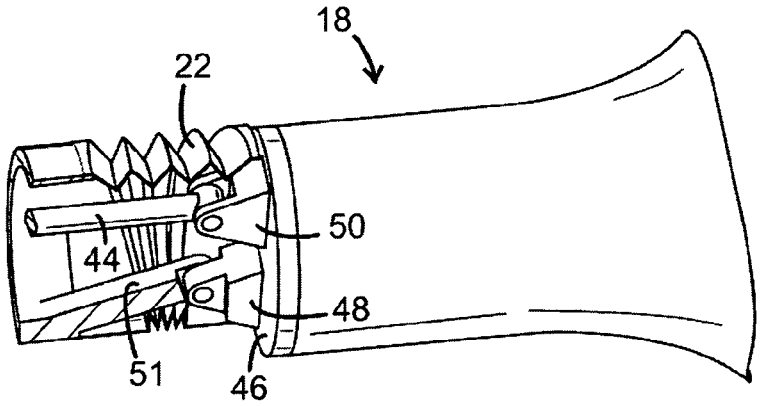
FIG. 4 is a cutaway side view corresponding to a detail in FIG. 2, showing an interface between a fluke oscillation drive and a fluke in more detail.

FIG. 4 shows a detail of how the interface between the fluke oscillation drive 16 and the fluke 18 may be implemented. The fluke 18 comprises a mounting plate 46 with a first pivot bracket 48 and a second pivot bracket 50. The first pivot bracket 48 is pivotally connected to the fluke oscillation drive 16 in a pivot support 51, which is fixed to or forms an integral part of the fluke oscillation drive housing 8. The second pivot bracket 50 is connected to the second end of the connecting rod 44, and rotationally journalled. A rotation of the crank shaft 38 will force the connecting rod 44 to move back and forth, and as a consequence the connecting rod 44 will force the fluke to swing back and forth, or oscillate, around a pivot axis 52. It may be possible to vary the fluke stroke length by varying the distance between the first pivot bracket 48 and the second pivot bracket 50, or by varying the axial offset of the crank pin 42 with respect to the rotation axis of the crank shaft 38, and thus adapt the fluke oscillation amplitude to a particular motor delivering a particular power.

The interface between the fluke oscillation drive 16 and the fluke 18 is protected by bellows 22.

Figure 5:
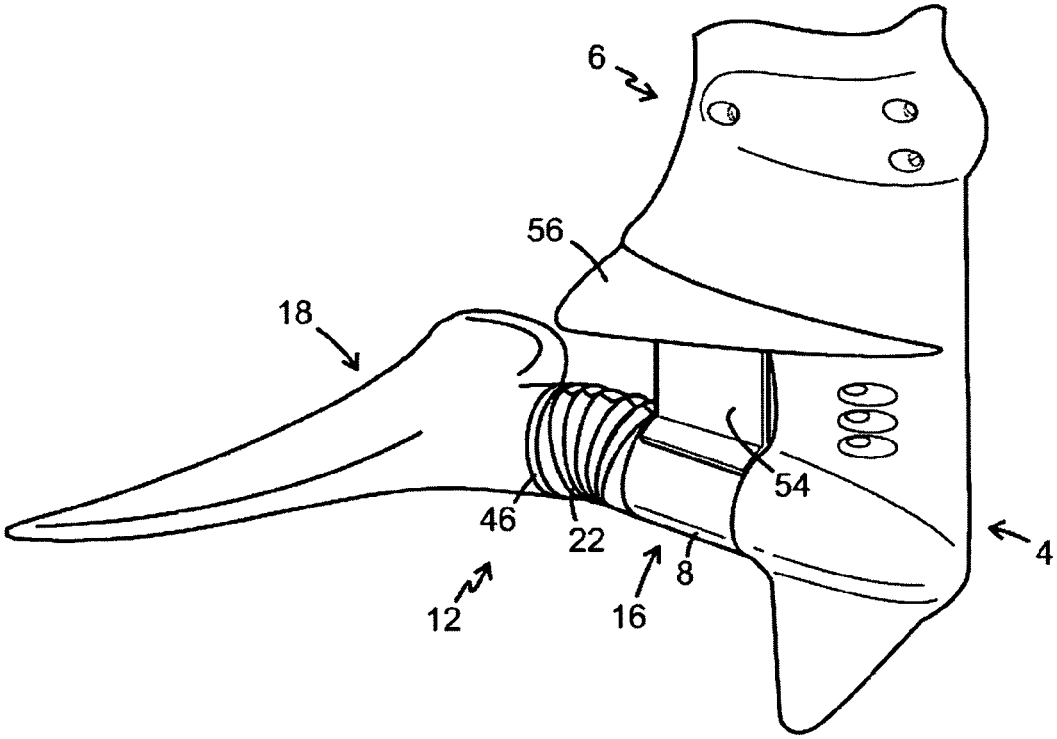
FIG. 5 is a view with parts broken away showing a propulsion device according to the invention mounted on an outboard motor.

FIG. 5 shows yet another embodiment of the invention. This figure particularly illustrates a support bracket 54 having one end connected to the housing 8 of the fluke oscillation drive 16 and another end connected to the cavitation plate 56 of an outboard engine 15. A similar support bracket may be used to connect the hull of the fluke oscillation drive to the cavitation plate of a stern drive or of a boat having an inboard engine, or even to the hull of a boat. Means may also be included for extending or shortening the support bracket 54, for fitting to different watercraft or motors.

Figure 6:
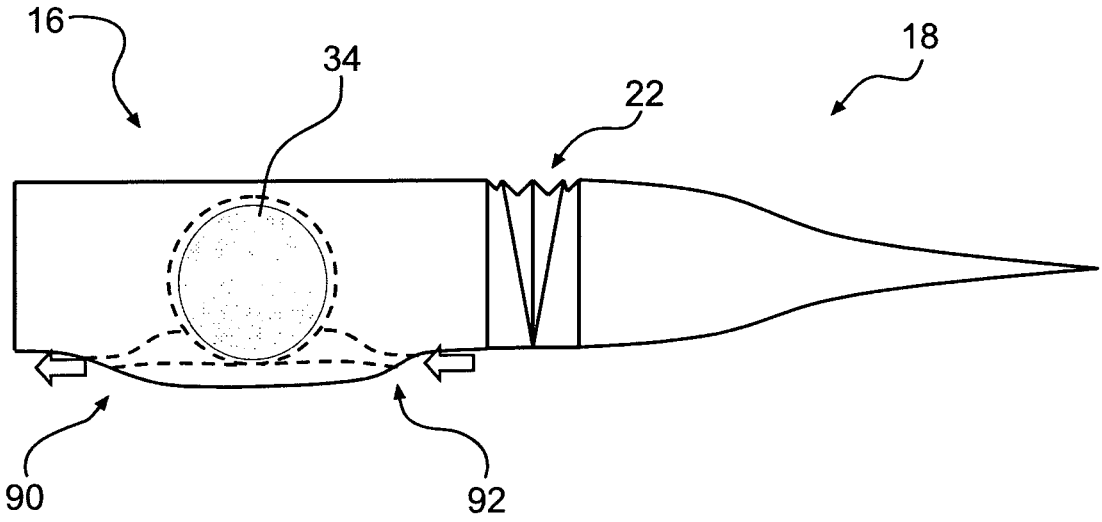
FIG. 6 is a diagrammatic cutaway side view of a watercraft propulsion device, illustrating an exemplary embodiment of an impeller.

FIG. 6 illustrates schematically one example of a suitable location of the impeller nozzles described above with reference to FIG. 3; the dashed lines illustrate the inlet and outlet channels, and the impeller housing. Again, the direction of the waterflow induced by the impeller, when operated, is indicated by arrows. The impeller 34 is configured to pump water from the inlet nozzle 92, and form a jet of water leaving the fluke oscillation drive 16 via the outlet nozzle 90. The jet is directed so as to propel the watercraft in a substantially reverse direction with respect to the propulsion direction resulting from operation of the fluke.

A skilled person may find many ways to practice the invention; the detailed description above is provided as an example only, and should not in any way be understood to limit the scope of the invention as defined in the appended claims.

The invention claimed is:

1. A propulsion device for propelling a floating watercraft, said propulsion device being adapted for connection to an output drive shaft that transmits a rotary motion, the propulsion device comprising a flexible fluke that is pivotable about a horizontal axis, and a fluke oscillation drive including a gear reducer for gear reduction of the rotary motion transmitted by the output drive shaft, and a rotary-to-oscillator motion conversion mechanism for converting the rotary motion transmitted by the output drive shaft to oscillatory motion of the fluke; wherein the fluke oscillation drive comprises an impeller for propelling the watercraft in a substantially reverse direction with respect to a propulsion direction resulting from operation of the fluke; and wherein the fluke oscillation drive comprises a disengagement mechanism for disengaging the fluke from the output drive shaft; and an engagement mechanism for engaging the impeller with the output drive shaft for propelling the watercraft in a substantially reverse direction with respect to a propulsion direction resulting from operation of the fluke.

2. The propulsion device according to claim 1, in combination with a watercraft including a propeller shaft forming the output drive shaft.

3. The propulsion device according to claim 1, wherein said gear reducer includes a worm gear.

4. The propulsion device according to claim 1, wherein the motion conversion mechanism includes a crankshaft and a connecting rod.

5. A propulsion device for propelling a floating watercraft, said propulsion device being adapted for connection to an output drive shaft that transmits a rotary motion, the propulsion device comprising a flexible fluke that is pivotable about a horizontal axis, and a fluke oscillation drive including a gear reducer for gear reduction of the rotary motion transmitted by the output drive shaft, and a rotary-to-oscillator motion conversion mechanism for converting the rotary motion transmitted by the output drive shaft to oscillatory motion of the fluke; and wherein the fluke oscillation drive includes an overrunning clutch for engaging and disengaging the fluke to and from the output drive shaft.

6. The propulsion device according to claim 1, wherein the gear reduction mechanism has a transmission ratio of between 8:1 and 32:1.

7. The propulsion device according to claim 1, wherein the fluke has the general shape of a tail of a bottle-nose dolphin.

8. The propulsion device according to claim 1, wherein the fluke is made of polyurethane and comprises steel reinforcements.

9. The propulsion device according to claim 1, wherein the gear reducer and the motion conversion mechanism are housed in a fluke oscillation drive housing.

10. The propulsion device according to claim 9, wherein the fluke oscillation drive housing is configured to be connected to a cavitation plate of a boat, a cavitation plate of a sterndrive, a cavitation plate of an outboard motor, or a hull of a boat via at least one support bracket.

11. The propulsion device according to claim 1, wherein the propulsion device is adapted to receive a rotary output power from the output drive shaft of more than 300 Watts.

12. The propulsion device according to claim 1, wherein the greater part of the fluke extends aft of the fluke's connection to the fluke oscillation drive.

13. The propulsion device according to claim 1, wherein the fluke comprises reinforcements for making the fluke cup when loaded and propel the water in a well-directed backward jet.

14. A conversion kit for replacing a rotatable propeller of a sterndrive or an outboard or inboard motor that is configured for operating the rotatable propeller at a rotary speed of more than 200 RPM, the kit comprising a propulsion device according to claim 1, said propulsion device being adapted to be connected to the propeller shaft of the motor or sterndrive.

15. A watercraft comprising a drive shaft and a watercraft propulsion device according to claim 1 driven by the drive shaft.

16. A method for increasing the efficiency of a watercraft propulsion device adapted for rotating a rotatable propeller at a rotary speed of more than 200 RPM by means of a propeller shaft, the method comprising replacing the rotatable propeller with a propulsion device according to claim 1.

17. The propulsion device according to claim 5, in combination with a watercraft including a propeller shaft forming the output drive shaft.

18. The propulsion device according to claim 5, wherein the fluke oscillation drive comprises an impeller for propelling the watercraft in a substantially reverse direction with respect to a propulsion direction resulting from operation of the fluke.

* * * * *

UNITED STATES PATENT AND TRADEMARK OFFICE

CERTIFICATE OF CORRECTION

PATENT NO. : 8,684,777 B2
APPLICATION NO. : 12/594359
DATED : April 1, 2014
INVENTOR(S) : Thomas Jemt It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 185 days.

Signed and Sealed this
Twenty-ninth Day of September, 2015

Michelle K. Lee

Michelle K. Lee
*Director of the United States Patent and Trademark Office*